US006193533B1

(12) United States Patent
De Win et al.

(10) Patent No.: US 6,193,533 B1
(45) Date of Patent: Feb. 27, 2001

(54) CONTACT SET

(75) Inventors: Paul De Win, Huizingen; Gunther Gubbelmans, Sint-Pieters-Leeuw, both of (BE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/243,453

(22) Filed: Feb. 3, 1999

(30) Foreign Application Priority Data

Feb. 4, 1998 (EP) ..... 98400233

(51) Int. Cl.[7] ..... H01R 29/00
(52) U.S. Cl. ..... 439/188
(58) Field of Search ..... 439/188, 676, 439/344, 218

(56) References Cited

U.S. PATENT DOCUMENTS

| | | | | |
|---|---|---|---|---|
| 4,261,633 | | 4/1981 | Abernethy . | |
| 4,682,827 | | 7/1987 | Thomas et al. . | |
| 4,699,443 | * | 10/1987 | Goodrich et al. | 439/188 |
| 4,717,217 | * | 1/1988 | Bogese, II | 439/344 |
| 4,725,241 | * | 2/1988 | Bertini et al. | 439/188 |
| 5,030,123 | * | 7/1991 | Silver | 439/188 |
| 5,123,854 | * | 6/1992 | Petersen et al. | 439/188 |
| 5,921,818 | * | 7/1999 | Larsen et al. | 439/676 |
| 5,951,330 | * | 9/1999 | Reichard, Jr. et al. | 439/676 |
| 5,961,354 | * | 10/1999 | Hashim | 439/676 |

FOREIGN PATENT DOCUMENTS

| | | |
|---|---|---|
| 0 692 884 A1 | 1/1996 | (EP) . |
| 0 755 100 A2 | 1/1997 | (EP) . |
| WO 97/41624 | 11/1997 | (WO) . |

* cited by examiner

*Primary Examiner*—Khiem Nguyen
*Assistant Examiner*—Hae Moon Hyeon
(74) *Attorney, Agent, or Firm*—Sughrue, Mion, Zinn, Macpeak & Seas, PLLC

(57) ABSTRACT

A contact set for connecting a multi-pair communication cable having wire pairs, including individually shielded wire pairs, has a male connector provided to be plugged into a female connector, the female connector including a first, a second, a third, and a fourth pair of connection pins provided for being connected to corresponding wires of the wire pairs. The female connector has a central pair and a further pair of pins that together form an aligned series of pins with the third and fourth pairs of pins. The two pins of the further pair of pins are located on both sides of the central pair of pins, the third and fourth pairs of pins being each located at a respective extremity of the series, the central pair of pins being connected to a first pair of electrical contacts connecting the central pair of pins with the first pair of pins, and the further pair of pins being connected to a second pair of electrical contacts connecting the further pair of pins with the second pair of pins so that upon connection of a first male connector having corresponding first and second pairs of pins provided in first and second holder parts separate from the other pins, the first and second pairs of electrical contacts are released, and upon connection of a second male connector having four aligned pairs of pins mating in the series of pins, the first and second pairs of electrical contacts are held.

13 Claims, 5 Drawing Sheets

CONTACT SET

BACKGROUND OF THE INVENTION

The present invention relates to a contact set for connecting a multi pair communication cable having wire pairs, in particular individually shielded wire pairs, said set comprising a male connector provided to be plugged into a female connector, said female connector comprising a first, a second, a third and a fourth pair of connection pins provided for being connected to corresponding wires of said wire pairs.

Such a contact set is known from EP 0 755 100, wherein said four pairs of pins are each provided in a separate holder part. By the provision of separate holder parts, crosstalk between the different pairs of connection pins is considerably reduced, providing good transmission characteristics up to and possibly beyond 600 MHz.

A drawback of this known contact set is that the female connector presents a specific configuration so that only a male connector having a corresponding specific configuration may be mated in the female connector. In particular, a known RJ-45 male connector may not be mated therein.

SUMMARY OF THE INVENTION

The object of the present invention is to provide a contact set which allows transmission with high frequencies, in particular up to and possibly beyond 600 MHz, but wherein the female connector is still compatible for plugging in known RJ-45 male connectors with frequencies up to 100 and 200 MHz (category 5 or 6 connectors).

To this object the contact set according to the invention is characterised in that said female connector comprises a central pair and a further pair of pins in such a manner to form an aligned series of pins with said third and fourth pairs of pins wherein said central pair is located in the middle of said series and the two pins of said further pair of pins are located on both sides of said central pair of pins, said third and fourth pairs of pins being each located at a respective extremity of said series, said central pair of pins being connected to a first pair of electrical contacts connecting the central pair of pins with said first pair of pins and said further pair of pins being connected to a second pair of electrical contacts connecting the further pair of pins with said second pair of pins in such a manner that upon connection of a first male connector having corresponding first and second pairs of pins provided in first and second holder parts separate from the other pins, said first and second pairs of electrical contacts are released, and upon connection of a second male connector consisting of four aligned pairs of pins mating in said series of pins, said first and second pairs of electrical contacts are held.

The formed configuration of eight aligned pins comprising the third and fourth pairs of pins and the additional pairs of pins, i.e. the central and further pairs of pins, corresponds to a configuration of an RJ-45 connector so that the obtained female connector is compatible for plugging in known RJ-45 connectors. By the provision of the electrical contacts between the central and first pairs of pins, on the one hand, and the further and second pairs of pins, on the other hand, the electrical signals when using an RJ-45 connector are transmitted from the central and further pairs of pins via the first and second pairs of pins to the wire pairs connected to the first and second pairs of pins. When plugging in a male connector having corresponding first and second pairs of pins, the electrical contacts are released so that electrical signals will be transmitted from the first, second, third and fourth pairs of pins from the male connector to the first, second, third and fourth pairs of pins from the female connector. This transmission may be achieved with high frequencies since the first and second pairs of pins of the male connector are located in separate holder parts, since the remaining third and fourth pairs of pins are sufficiently spaced apart from each other, i.e. at both extremities of the aligned series and since the central and further pairs of pins do not receive electrical signals, the electrical contacts with the first and second pairs of pins being released. Thus, the electrical signals do not reach the central and further pairs of the female connector. This results in an absence of crosstalk between those pins.

In order to further reduce interference, each pair of pins in said first male connector is provided in a corresponding holder part, each holder part being separated from one another by means of a shield. Preferably, said shield is provided for grounding said further pair of pins of the female connector upon connection of said first male connector.

Preferably, said male connector comprises a corresponding central pair of connection pins provided to be mated into the central pair of pins in the female connector. This enables to use the central pairs of pins for additional electrical signals.

The invention also relates to a female connector to be used in a contact set according to the invention.

BRIEF DESCRIPTION OF THE DRAWINGS

The invention will now be described further in detail referring to the annexed drawings, wherein.

DETAILED DESCRIPTION OF THE INVENTION

Figure 1:
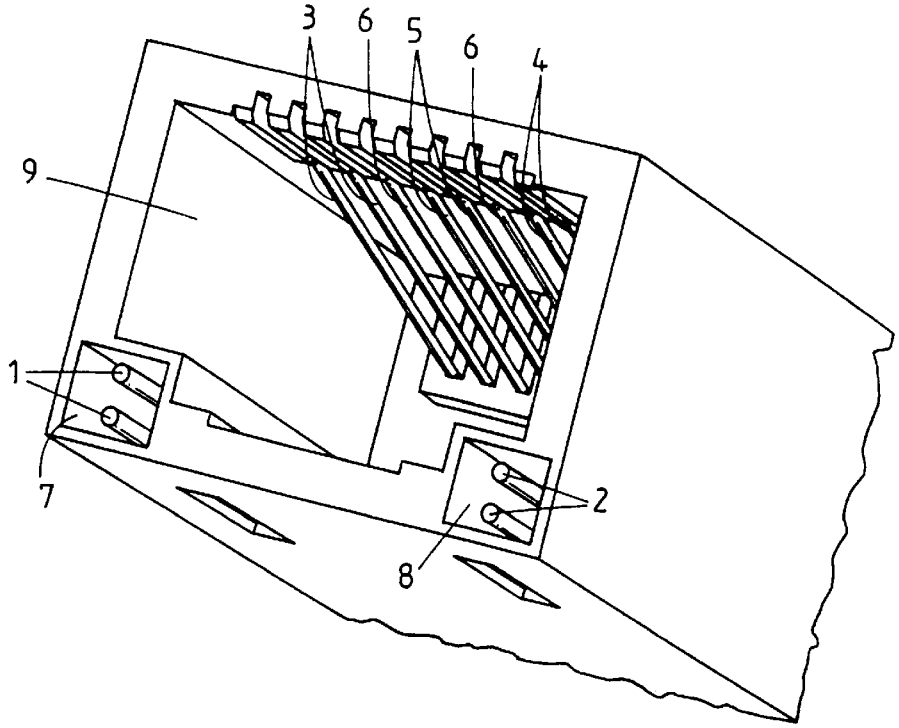
FIG. 1 is a perspective view illustrating the front part of a female connector according to the invention.
Figure 2:
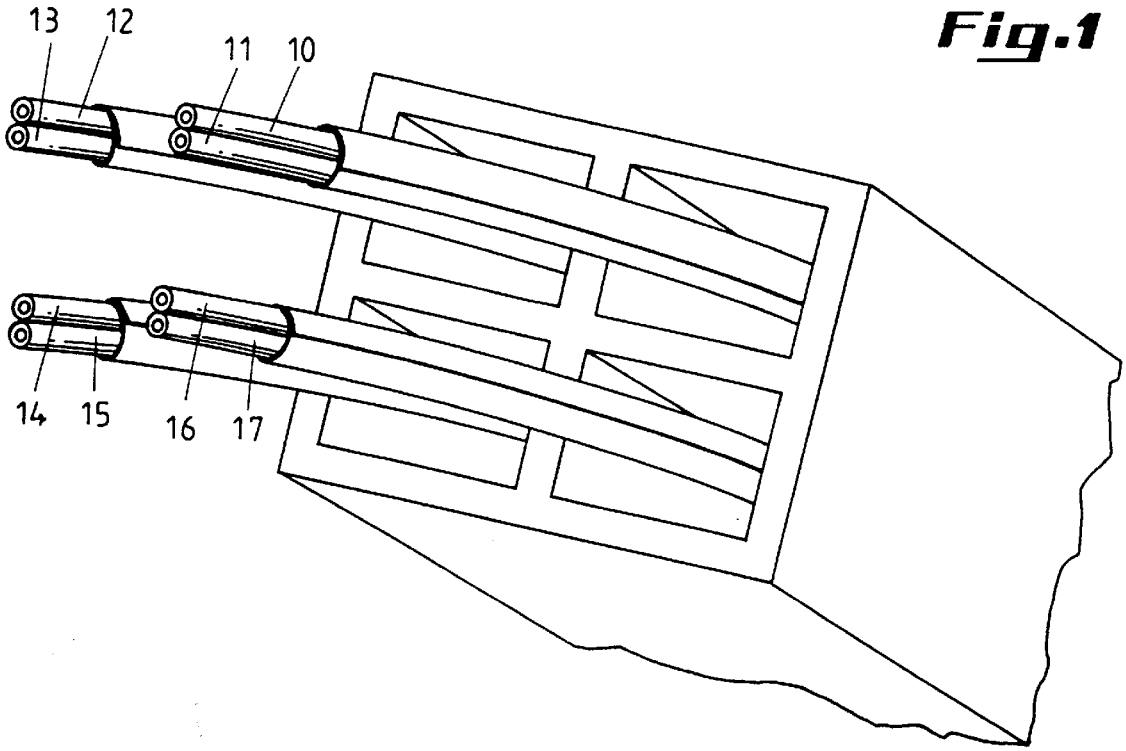
FIG. 2 is a perspective view illustrating the back part of the female connector according to FIG. 1.

Referring to FIGS. 1 and 2, there is illustrated a female connector according to the invention. This connector comprises a first pair of connection pins 1 located in a first holder part 7 and a second pair of connection pins 2 located in a second holder part 8. A further holder part 9, is designed for receiving an RJ-45 male connector as will be described further. This further holder part comprises a series of connection pins 3 to 6, comprising at a first extremity of the series a third pair of connection pins 3 and at the other extremity a fourth pair of connection pins 4. As illustrated in FIG. 2, a series of eight wires 10–17 are provided for being connected to the connection pins 1 to 4 respectively. The pairs of wires are separated from one another in order to reduce crosstalk at their connection with the connection pins. Preferably, each pair of wires is shielded, as illustrated in FIG. 2.

According to the invention, there are provided a central pair 5 and a further pair 6 of connection pins, so as to mate with the corresponding pins provided in a standard RJ-45 male connector, as will be described further when referring to FIGS. 7 and 8.

Figure 5:
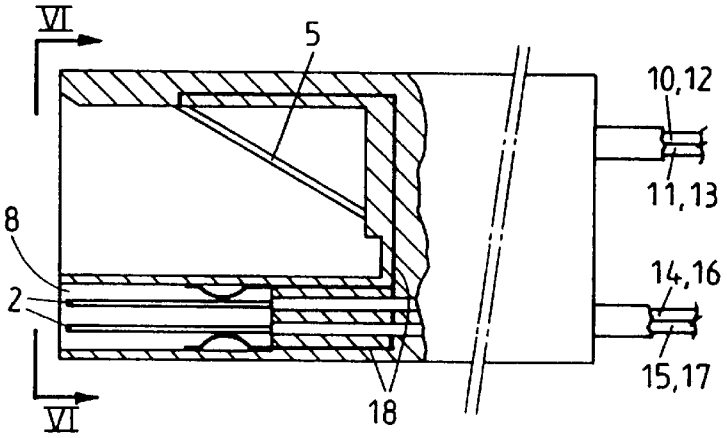
FIGS. 5 and 6 illustrate a side and a front view of the female connector according to FIG. 1.

FIG. 5 illustrates that the further pair 6 of connection pins from the female connector is electrically connected to the second pair 2 of connection pins, by means of electrical connections 18. Similarly the central pair 5 of connection pins is electrically connected to the first pair 1 of connection pins (not shown). When plugging in a male connector having corresponding holder parts 7' and 8' (FIGS. 3 and 4) with corresponding first 1' and second 2' pairs of connection pins, the electrical connections 18 are released, so that signals transmitted through wires 14' to 17' will be transmitted to the wires 14 to 17 through the intermediary of pins 1'–1 and 2'–2 and will not pass through the pins 5 and 6. Signals transmitted through wires 10' to 13' will be transmitted to the wires 10 to 13 through the intermediary of pins 4'–4 and 3'–3. Since those pins 4'–4 and 3'–3 are located at the extremities of the series of pins, as clearly illustrated in FIGS. 4 and 6, crosstalk between those pairs of pins is rather limited, even with high transmission frequencies up to 600 MHz.

Preferably the holder part 8' from the male connector comprises a shield 19 (FIGS. 3–4) in such a manner that upon plugging in this connector in the female connector (FIGS. 5–6), the further pair 6 of pins may be grounded since the released electrical connection 18 comes into contact with the shield 19.

Additionally, the holder part 7' could for the same reason also be shielded so as to ground the central pair 5 of pins. According to an alternative, the central pair is not grounded but used for an additional signal. For this purpose, the male connector comprises a corresponding central pair 5' of pins. Possibly the male connector may also comprise a further pair 6' of pins. In the male connector, the first 1' and second 2' pairs of pins are not connected to the central 5' and further 6' pairs of pins.

Figure 6:
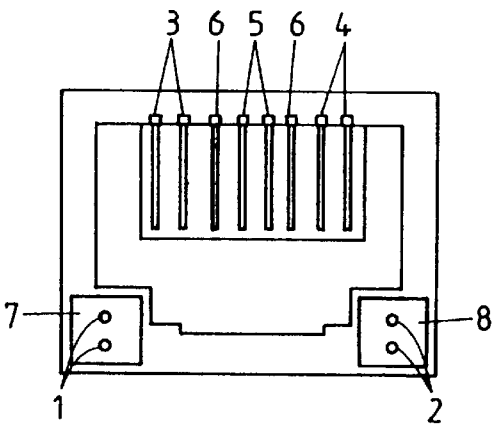
Figure 8:
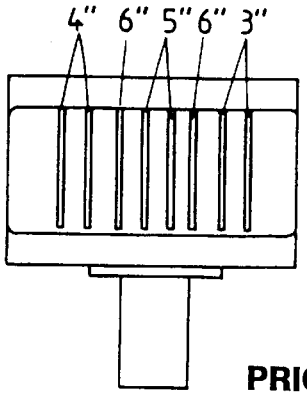
PRIOR ART Fig.8
FIGS. 7 and 8 illustrate an RJ-45 male connector.
Figure 7:
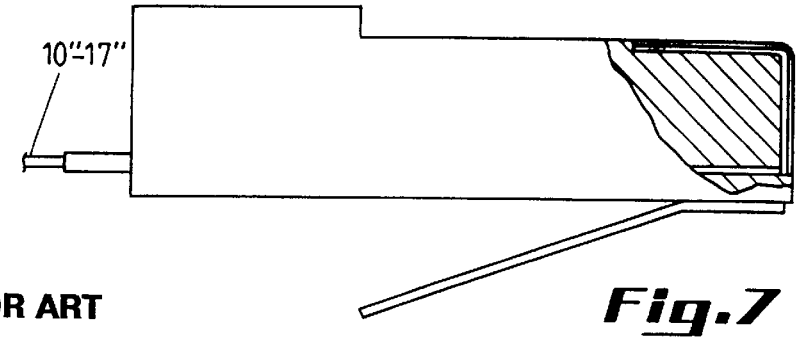
Fig.7 PRIOR ART

FIGS. 7 and 8 illustrate a standard RJ-45 male connector. When plugging in such a connector into the female connector (FIGS. 5 and 6) according to the invention, the first 1 and second 2 pairs of pins are not connected to corresponding pins of the male connector. There are however wires 14 to 17 which are connected to those pins 1 and 2. The electrical connections 18 guarantee the transmission of signals from the corresponding wires 14" to 17" from the male connector (FIG. 7) to the wires 14 to 17 from the female connector, since the signals are transmitted from the central 5 and further 6 pairs of pins to the first 1 and second 2 pairs of pins and follow the path 5"-5-1-14&15 and 6"-6-2-16&17.

Figure 3:
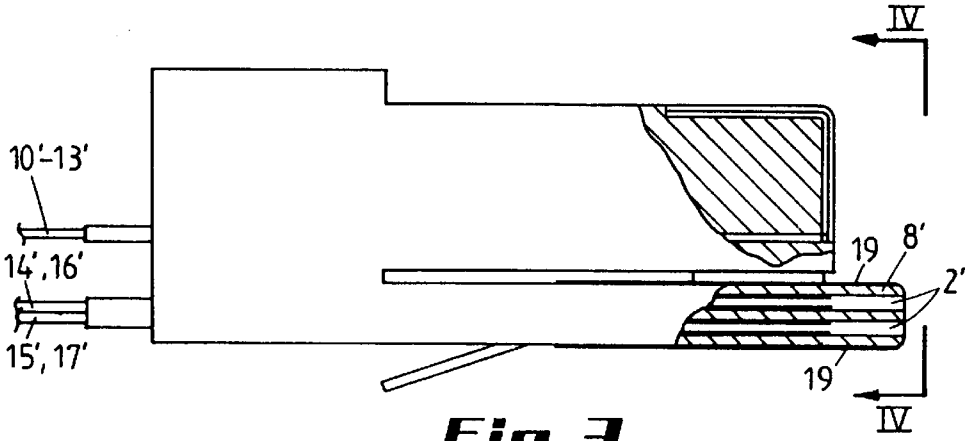
FIGS. 3 and 4 illustrate a side and a front view of a male connector according to a first preferred embodiment of the invention.
Figure 4:
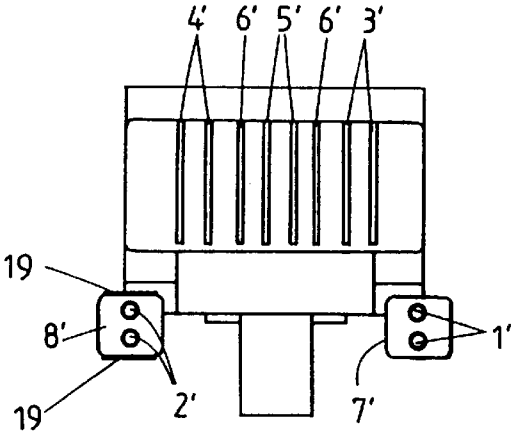

It should be noted that the central and further pairs of pins may be omitted from the male connector of FIGS. 3 and 4, or may be used according to an alternative for additional signals.

Turning now to FIGS. 9 to 17, there is shown a second preferred embodiment of the contact set according to the invention. Same reference numerals have been given to same or similar features.

Figure 9:
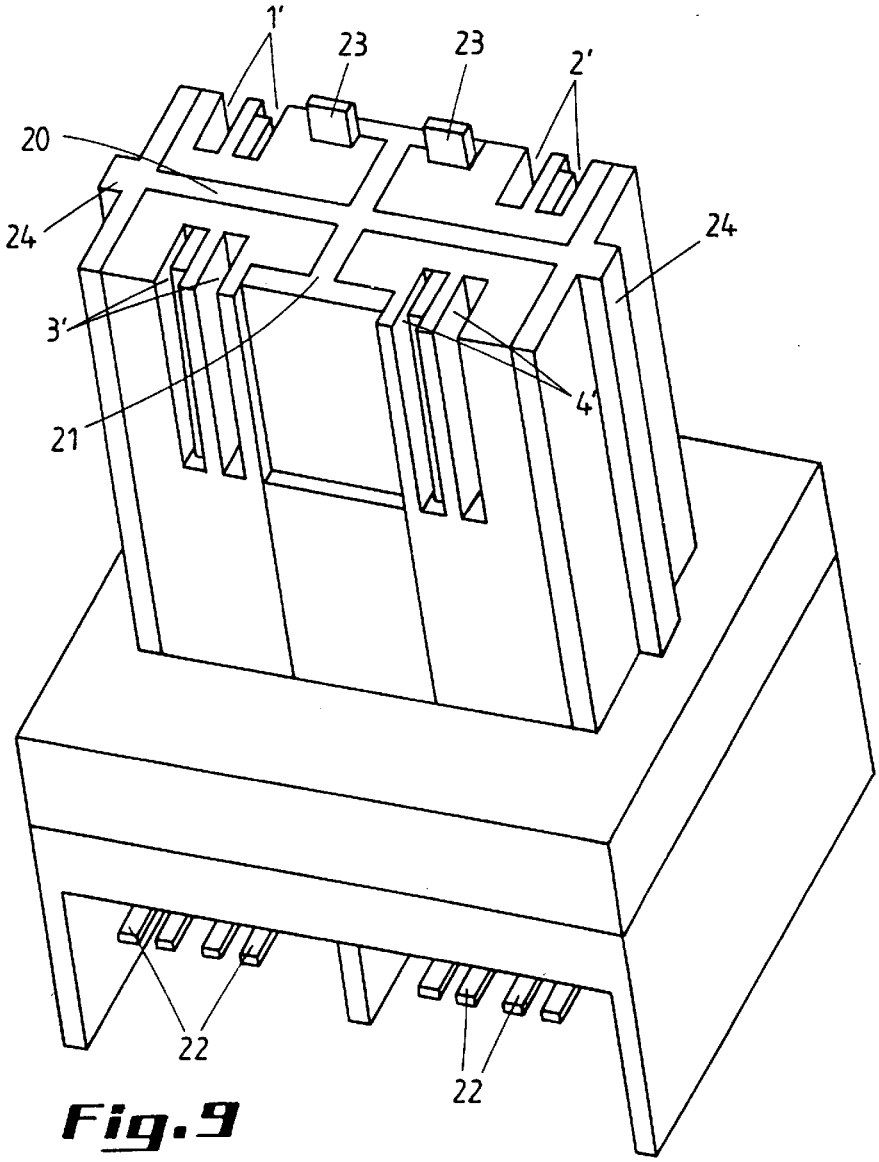
FIG. 9 is a perspective view of a male connector according to a second preferred embodiment of the invention.

The male connector according to FIG. 9 comprises also the first 1', second 2', third 3' and fourth 4' pair of pins as described before. According to this embodiment, each pair of pins is provided in a corresponding holder part. Accordingly there are four holder parts, which are separated by a shield 20. Preferably the shield 20 is provided for grounding the further pair of pins 6 of the female connector (see FIG. 15) upon connection of the male connector. This may for example be achieved by providing a connection plate 21 connecting the shield 20 with the pins 6. According to this embodiment, the central pair of pins 5 is also grounded. According to an alternative, the shield makes only contact with the further pair of pins so that the central pair of pins may be used for an additional electrical signal.

The male (FIG. 12) and female (FIG. 17) connectors further comprise connection forks 22 provided for readily connecting the wires of the cable (not shown).

Figure 14:
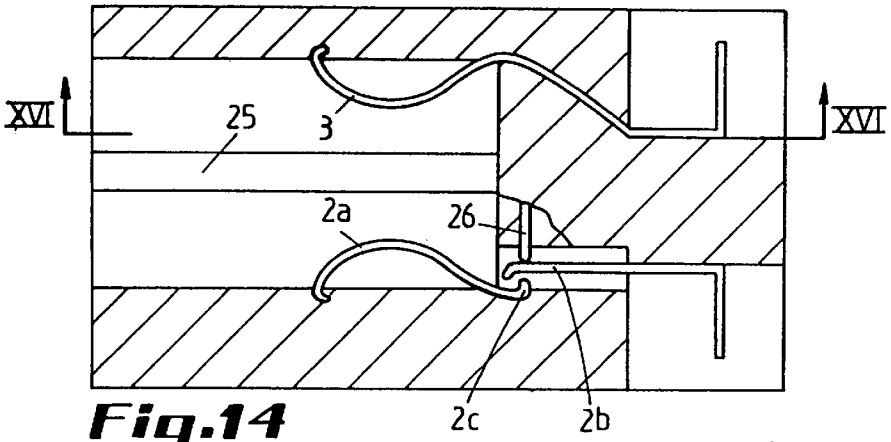
FIG. 14 is a side sectional view of the female connector taken along line XIV—XIV from FIG. 15.
Figure 16:
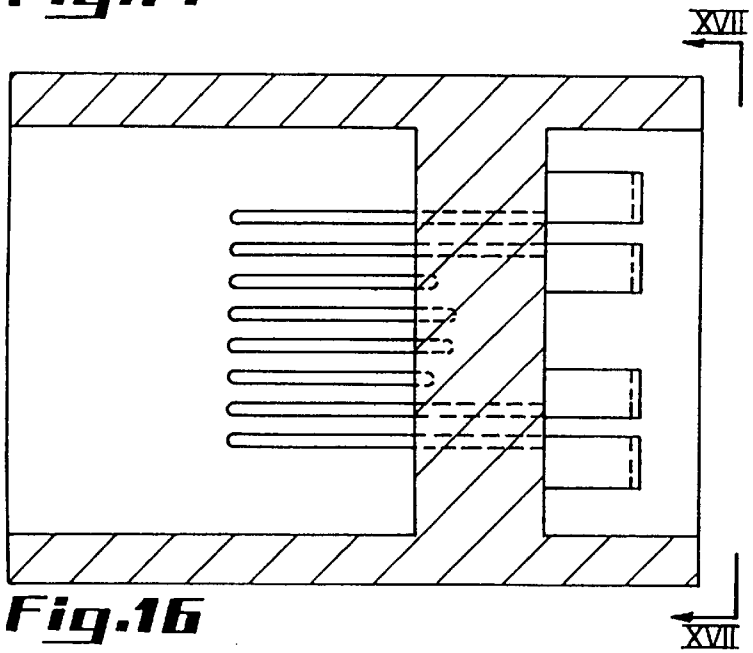
FIG. 16 is a top view of the female connector taken along line XVI—XVI from FIG. 14.

As illustrated in FIG. 14, the second connection pins 2 are separated into two portions **2*a* and 2*b*. Similarly, the first connection pins 1 are separated into two portions (not shown). The central pair of pins 5 is connected to a first electrical contact (not shown) connecting the central pair of pins with the first pair of pins 1. Similarly, each pin of the further pair of pins 6 is connected to a second electrical contact 26 connecting the further pair of pins 6 with the second portion 2*b*** of the second pair of pins.

Figure 11:
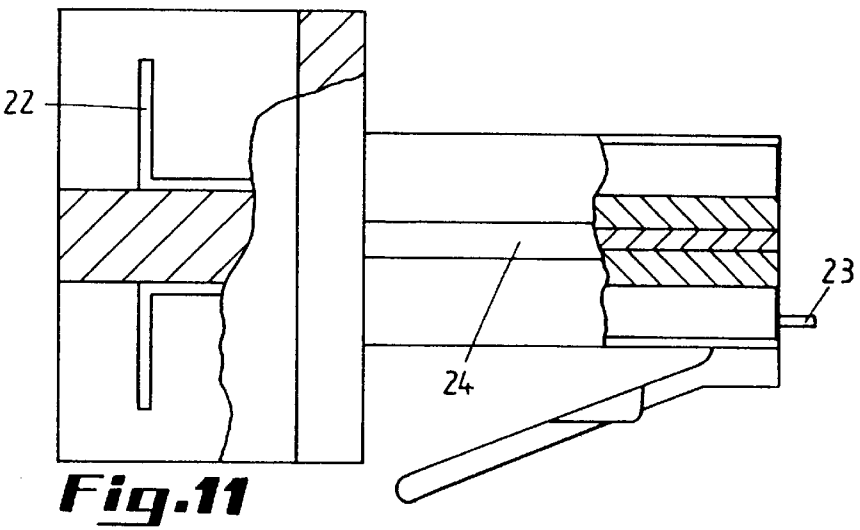
FIG. 11 is a side view of the male connector according to FIG. 9.
Figure 13:
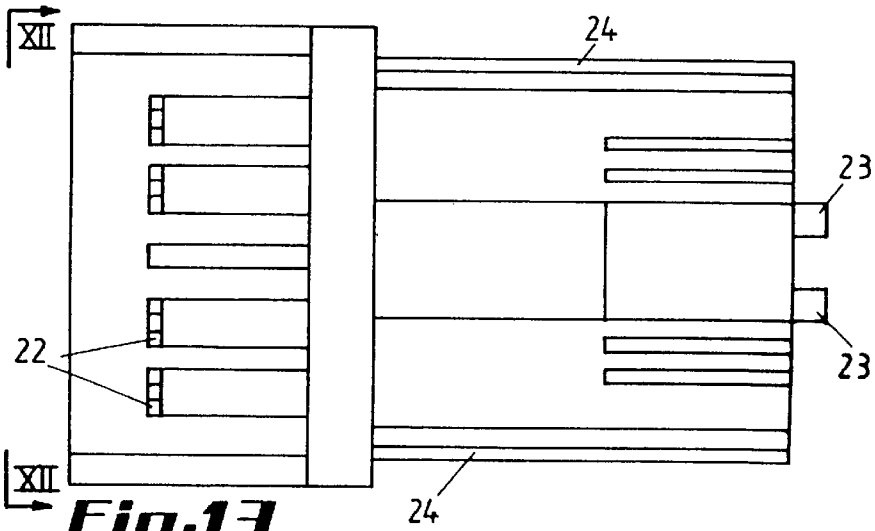
FIG. 13 is a top view of the male connector according to FIG. 9.
Figure 10:
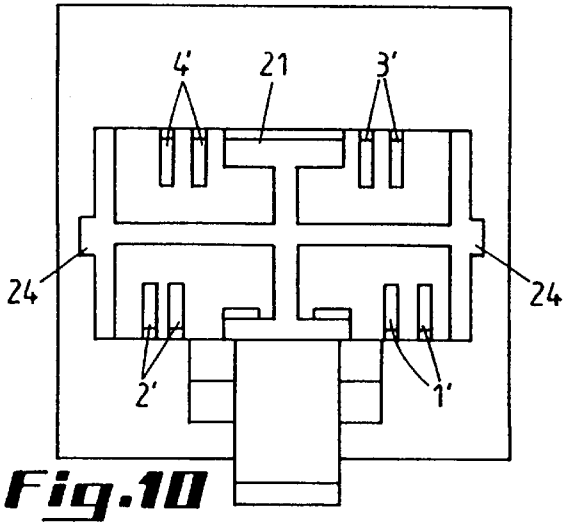
FIG. 10 is a front view of the male connector according to FIG. 9.
Figure 12:
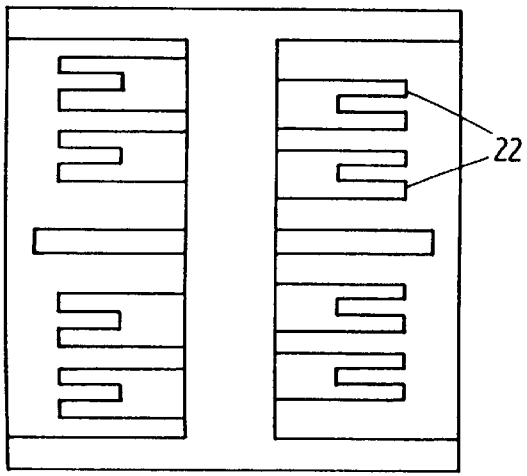
FIG. 12 is a back view of the male connector according to FIG. 9.

Upon connection of the male connector according to FIG. 11 into the female connector according to FIG. 14, protrusion 23 provided on the male connector will release the contact between the second electrical contact 26 from the second portion **2*b* of the second connection pins and connect at the same time the first portion 2*a* with the second portion 2*b* from the second pair of pins so that electrical signals from the wires connected to the second pair of pins 2' of the male connector are transmitted to the corresponding wires connected to the second pair of pins 2 of the female connector. Similarly, protrusion 23 will release the contact between the first electrical contact (not shown) from the second portion of the first connection pins and connect at the same time the first portion with the second portion from the first pair of pins 1 so that electrical signals from the wires connected to the first pair of pins 1' of the male connector are transmitted to the corresponding wires connected to the first pair of pins 1** of the female connector.

Figure 15:
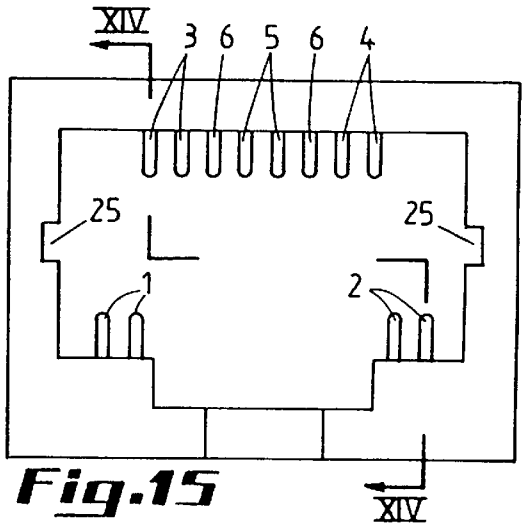
FIG. 15 is a side view of a female connector according to a second embodiment provided for receiving the male connector according to FIGS. 9 to 13.
Figure 17:
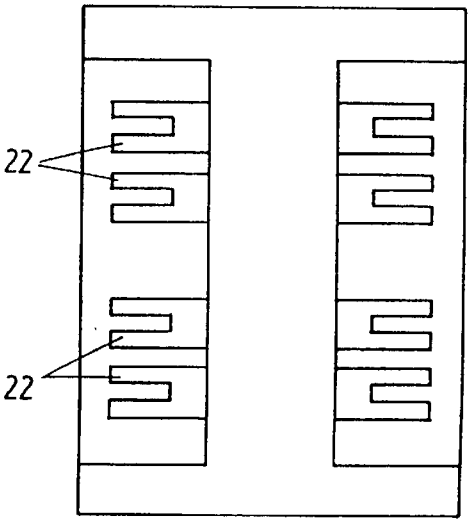
FIG. 17 is a back view of the female connector according to FIG. 14.

Preferably the male connector according to FIGS. 9 to 13 comprises a protuberance 24 and the female connector comprises corresponding notches 25 (as illustrated in FIG. 15), in order to prevent the connection of the male connector according to the invention in a conventional female RJ-45 connector. Connection of a conventional RJ-45 male connector to the female connector according to the invention is still enabled.

Upon connection of a conventional RJ-45 male connector, the first electrical contact connecting the central pair of pins with the first pair of pins will be held, so that electrical signals from the wires connected to the central pair of pins of the conventional male connector are transmitted to the wires connected to the first pair of pins 1 of the female connector. Similarly, the second electrical contact 26 connecting the further pair of pins 6 with the second pair of pins **2*b* will be held, so that electrical signals from the wires connected to the central pair of pins of the conventional male connector are transmitted to the wires connected to the second pair of pins 2***b* of the female connector.

Upon comparison of the two preferred embodiments, in particular FIGS. 6 and 15, it will be clear that the different pairs of pins in the female connector must not mandatory be provided in separate holder parts. In the male parts however (see FIGS. 4 and 10) separation between at least the first, second and other pairs pins must be provided. Preferably, a separation between the third and fourth pair of pins is achieved by providing a shield for grounding at least said further pair of pins.

The description always referred to signals from the wires connected to the male connector to the wires of the female connector. It should be clear that signals may also be transmitted in the other direction.

What is claimed is:

1. A connector set for connecting wire pairs, said set comprising a female connector and a male connector provided to be plugged into said female connector, said male connector being one of a first type and a second type, said female connector comprising:

first, second, third, and fourth pairs of pins;

a central pair of pins;

an intermediate pair of pins;

a first pair of electrical contacts for electrically connecting or disconnecting said first pair of pins and said central pair of pins; and a second pair of electrical contacts for electrically connecting or disconnecting said second pair of pins and said intermediate pair of pins, wherein:

said pairs of pins are provided for being connected to corresponding wires of said wire pairs;

said central, intermediate, third, and fourth pairs form an aligned series of pins;

said central pair is located in the middle of said series;

the two pins of said intermediate pair are located, respectively, on opposite sides of said central pair;

said third and fourth pairs are located, respectively, on opposite ends of the series, and wherein:

said first and second pairs of electrical contacts are held for performing said disconnecting when said first type of male connector is inserted, said first type having two pairs of pins that respectively mate with said first and second pairs of pins, said two pairs each being disposed, respectively, in first and second holder parts; and said first and second electrical contacts are released for performing said connecting when said second type of male connector is inserted, said second type having four sets of pins that are aligned to correspondingly mate with said aligned series of pins.

2. A connector set according to claim 1, wherein said first and second holder parts are each shielded with a common shield, said holder parts being separated from each other and from said aligned series of pins.

3. A connector set according to claim 2, wherein said shield is provided for grounding said intermediate pair of pins of the female connector upon connection of said first type of male connector.

4. A connector set according to claim 1, wherein a shield is provided around said second holder part in such a manner to ground said intermediate pair of pins provided on the female connector upon connection of said first type of male connector.

5. A connector set according to claim 1, wherein said male connector comprises a corresponding central pair of connection pins provided to be mated into the central pair of pins in the female connector.

6. A connector set according to claim 1, wherein said male connector comprises a protuberance and said female connector comprises a corresponding notch for receiving said protuberance.

7. A female connector provided to be plugged into a male connector for connecting wire pairs, said male connector being one of a first type and a second type, said female connector comprising:

first, second, third, and fourth pairs of pins;

a central pair of pins;

an intermediate pair of pins;

a first pair of electrical contacts for electrically connecting or disconnecting said first pair of pins and said central pair of pins; and a second pair of electrical contacts for electrically connecting or disconnecting said second pair of pins and said intermediate pair of pins, wherein:

said pairs of pins are provided for connecting to corresponding wires of said wire pairs;

said central, intermediate, third, and fourth pairs form an aligned series of pins;

said central pair is located in the middle of said series;

the two pins of said intermediate pair are located, respectively, on opposite sides of said central pair;

said third and fourth pairs are located, respectively, on opposite ends of the series, and wherein:

said first and second electrical contacts are held for performing said disconnecting when said first type of male connector is inserted; and said first and second electrical contacts are released for performing said connecting when said second type of male connector is inserted.

8. A male connector provided to be plugged into a female connector for connecting wire pairs, said male connector comprising:

first, second, third, and fourth pairs of pins;

a central pair of pins;

an intermediate pair of pins; and first and second holder parts, respectively having first and second sets of pins for mating with corresponding pins of said female connector, said first and second holder parts for engaging a corresponding first and second pair of electrical contacts of said female connector for holding the electrical contacts to be electrically open when said male connector is mated with said female connector and for releasing the electrical contacts to be electrically closed when said male connector is removed from said female connector, wherein:

said pairs of pins are provided for connecting to corresponding wires of said wire pairs;

said central, intermediate, third, and fourth pairs form an aligned series of pins;

said central pair is located in the middle of said series;

the two pins of said intermediate pair are located, respectively, on opposite sides of said central pair; and said third and fourth pairs are located, respectively, on opposite ends of the series.

9. A connector set according to claim 4, wherein said reception of said protuberance by said notch effects said connecting.

10. A connector set according to claim 1, wherein said male connector comprises a protuberance and said female connector comprises a corresponding notch for receiving said protuberance, and wherein each of the pins of said first and second pairs of pins each comprise first and second portions, and wherein said reception of said protuberance by said notch effects a releasing of each of said second portions from corresponding ones of said electrical contacts while simultaneously effecting a connection of each of said first portions with each corresponding one of said second portions, thereby passing electrical signals from said first and second pairs of pins to said two pairs of pins.

11. A connector set according to claim 1, wherein said male and female connectors each further comprise a plurality of connection forks for connecting said wire pairs to corresponding ones of said pairs of pins.

12. A female connector according to claim 5, wherein said female connector and said male connector comprise a contact set for connecting a multi pair communication cable, and wherein said wire pairs are individually shielded.

13. A male connector according to claim 6, wherein said female connector and said male connector comprise a contact set for connecting a multi pair communication cable, and wherein said wire pairs are individually shielded.

* * * * *